US010518378B2

(12) United States Patent
Hundebol

(10) Patent No.: US 10,518,378 B2
(45) Date of Patent: Dec. 31, 2019

(54) SURFACE TREATMENT TOOL

(71) Applicant: HH Patent A/S, Ansager (DK)

(72) Inventor: Keld Otting Hundebol, Ansager (DK)

(73) Assignee: HH PATENT A/S (DK)

( * ) Notice: Subject to any disclaimer, the term of this patent is extended or adjusted under 35 U.S.C. 154(b) by 191 days.

(21) Appl. No.: 15/567,310

(22) PCT Filed: Apr. 18, 2016

(86) PCT No.: PCT/DK2016/000016

§ 371 (c)(1),
(2) Date: Oct. 17, 2017

(87) PCT Pub. No.: WO2016/169565

PCT Pub. Date: Oct. 27, 2016

(65) Prior Publication Data

US 2018/0117727 A1 May 3, 2018

(30) Foreign Application Priority Data

Apr. 23, 2015 (DK) ..... 2015 00252

(51) Int. Cl.
*B24B 19/26* (2006.01)
*B24B 41/04* (2006.01)
(Continued)

(52) U.S. Cl.
CPC ..... *B24B 19/26* (2013.01); *B24B 27/0038* (2013.01); *B24B 27/0076* (2013.01);
(Continued)

(58) Field of Classification Search
CPC . B24B 19/26; B24B 27/0038; B24B 27/0076; B24B 27/0084; B24B 41/00;
(Continued)

(56) References Cited

U.S. PATENT DOCUMENTS 939,373 A 11/1909 Allen
2,240,876 A 5/1941 Waterud
(Continued)

FOREIGN PATENT DOCUMENTS

BE 562676 5/1958
DE 20318660 2/2004
(Continued)

OTHER PUBLICATIONS

International Search Report Application No. PCT/DK2016/000016 completed: Jul. 19, 2016; dated Jul. 27, 2016 4 pages.
(Continued)

*Primary Examiner* — Eileen P Morgan
(74) *Attorney, Agent, or Firm* — Ware, Fressola, Maguire & Barber LLP

(57) ABSTRACT

By, according to the invention, designing a surface treatment tool with a grinding head (16, 17) with cylindrical rollers (18), so that the tool (16, 17, 18) is balanced by weight because the tool's centre of gravity is close to the tool's surface treatment area, the tool (18) will automatically adjust according to the surface (25) of the treated workpiece, regardless of the level of the surface. Hereby is achieved a previously unknown simple way to surface treat, be it flat and curved workpiece surfaces alike. Furthermore, the tool (16,17,18) is balanced by weight so that treatment pressure can be adjusted according to need.

4 Claims, 2 Drawing Sheets

(51) Int. Cl.
*B24B 27/00* (2006.01)
*B24D 13/10* (2006.01)
*B24B 41/047* (2006.01)

(52) U.S. Cl.
CPC ..... *B24B 41/04* (2013.01); *B24B 41/042* (2013.01); *B24B 41/047* (2013.01); *B24D 13/10* (2013.01)

(58) Field of Classification Search
CPC ..... B24B 41/04; B24B 41/042; B24B 41/047; B24D 13/10
USPC ..... 451/59, 211
See application file for complete search history.

(56) References Cited

U.S. PATENT DOCUMENTS 2,420,876 A * 5/1947 Freud ..... B24B 41/047 451/211
4,615,146 A * 10/1986 Tassoni ..... B08B 1/02 15/77
4,646,473 A * 3/1987 Hundebol ..... B24B 7/00 144/114.1
RE34,014 E * 8/1992 Hundebol ..... B24B 7/00 144/114.1
5,274,962 A * 1/1994 Hundebol ..... B24B 7/12 451/124
5,558,561 A * 9/1996 Hundebol ..... B24B 7/12 451/178
5,601,481 A * 2/1997 Hundebøl ..... B24B 7/12 451/178
5,690,545 A 11/1997 Clowers et al.
6,015,334 A * 1/2000 Hundebøl ..... B24B 41/047 451/28
6,234,887 B1 * 5/2001 Hundebøl ..... B24B 7/12 451/358
8,715,038 B2 * 5/2014 Cheon ..... B24B 27/033 451/109
2003/0040265 A1 2/2003 Palushi
2005/0054279 A1 3/2005 Jordan
2014/0113525 A1 4/2014 Chan

FOREIGN PATENT DOCUMENTS

FR 3001169 7/2014
WO 2009014511 1/2009

OTHER PUBLICATIONS

International Preliminary Report on Patentability Application No. PCT/DK2016/000016 dated Aug. 17, 2017 10 pages.

* cited by examiner

SURFACE TREATMENT TOOL

PRIOR ART

The disclosure relates to a surface treatment tool for treatment of workpiece surfaces, which tool comprises a rotating tool head on which is radially mounted several rotating tools, which tools comprise cylindrical cutting or grinding rollers.

Surface treatment in the form of grinding, deburring, delustring, polishing, etc., of workpieces either for the purpose of finishing or to make the surface suitable for additional treatment, such as application of a surface layer or for pre-treatment of surfaces that are to be joined, is very widespread and therefore the need for efficient equipment for these purposes is substantial.

Concurrently, the development towards large curved surfaces such as segments for airplanes, automobiles, trains, wind turbine blades, and the like, with so-called three-dimensional surfaces has increased, and such large workpieces are also to be surface treated, for example in preparation for joining with other components or for the purpose of a finishing surface treatment.

Equipment for surface treatment of flat as well as curved surfaces of limited size is known. Thus, such workpieces will be of the kind that they can either be placed on a conveyor and pass through a treatment machine or the equipment can be moved across the workpiece.

From FR 3001 169 A1 is known a grinder for grinding of curved surfaces (12). The head of the tool is gimballed in the suspension. In one embodiment the head of the tool is equipped with opposite bearings (52) with a tilt axis (50), to which the suspension (54) is mounted. The suspension (54) is mounted to a fitting aperture (56) with a tilt axis (50) which is perpendicular on the axis (50). The fitting aperture (56) comprises a supporting frame (22, 46), which by its opposite end is mounted to the bracket of the tool (40, 42). The supporting arm is supported by a weight compensator consisting of a spring or a pneumatic cylinder. However, as the grinding wheel is designed to face sidewards, and not downwards, the weight compensator does not affect the pressure of the tool against the workpiece surface. For that is used another actuator which presses the head of the tool against the surface by rotation about the axis.

Furthermore is known from U.S. Pat. No. 939,373 A a surface treatment tool comprising a rotating tool head (31) on which is radially mounted several grinding rollers (37) where each roller is mounted around an axis, which is perpendicular on the rotary axis of the tool head. The tool comprises a suspension (24, 25) which is supported by an adjustable weight compensator (53, 57, 59) for adjustment of the pressure of the tool head against the workpiece surface.

These known tools, however, suffer several disadvantages. Primarily that the tool is not balanced as to weight, which leads to a variable grinding effect as the pressure of the tool against the workpiece surface is not constant but variable. There is no kind of self-regulation of the grinding effect.

SUMMARY

An objective is to remedy these limitations and inconveniences, and this is achieved, according to the invention, using a surface treatment tool for treatment of workpiece surfaces, which tool comprises a rotating tool head on which is radially mounted several rotating tools, which rotating tools include cylindrical, cutting or grinding rollers, wherein the tool head is fitted with opposite bearings being rotatably mounted to ends of a suspension thereby providing said tool head with an axis of rotation; wherein the suspension is rotatably mounted to a fitting bearing thereby providing the suspension with an axis of rotation which is perpendicular to the axis of rotation of the tool head; wherein the fitting bearing is rotatably mounted to a fitting bracket that is tiltable about a tilt axis perpendicular to the axis of rotation of the suspension, wherein the ends of said suspension are rotatably mounted to said opposite bearings at a position below the fitting bracket such that the axis of rotation of the tool head is positioned at a level below the axis of rotation of the suspension.

In this surprisingly simple way is obtained a self-adjustable tool which can treat a surface, whether it is flat or curved, as the tool itself follows the shape of the workpiece because of its suspension. Thus the treatment tool automatically adjusts to the shape of the workpiece without the need for other control, all because of the balanced suspension.

Thus, the tool suspension constitutes a 'balanced' suspension, and contributes to a constant self-regulation of the tool during its rotation. The effect is similar to gyro-devices where a flywheel, tool head, with a stable rotational movement on a perpendicular level combined with a rotation of the flywheel, the tool head around the axis. This non-intuitive movement of the axis is called precession.

In other words, the tool is self-aligning and can adjust to the surface shape as the centre of gravity is close to the tool's central point of treatment. This contributes to achieving the balanced tool which easily and effortlessly can follow the surface of the workpiece as it will constantly seek to adjust its working positions to the surface conditions.

Furthermore is achieved a treatment operating radius which alone depends on the extension of the suspension.

By mounting the suspension on a supporting frame, which is mounted on the support bracket or base plate of the tool, the area of treatment will be of such a size that it is only limited by the distance between the bracket and the tool head itself and, in addition, the tool will be able to treat relatively substantial level differences on the workpiece.

By supporting the supporting arm by means of a weight compensator for balancing the weight of the tool it is possible to adjust the tool to the desired treatment pressure and the desired treatment force.

By allowing the tool's suspension to be rotatably mounted in a fitting bracket it is possible to treat workpiece surfaces that are similarly oriented.

Finally, it is appropriate to use such a tool for treatment of shaped surfaces as the tool will be able to follow the surface contours by itself without further adjustments.

BRIEF DESCRIPTION OF THE DRAWING

An embodiment for a surface treatment tool will be described in detail in the following with reference to the drawing where.

DETAILED DESCRIPTION

The embodiment shown in the figures will in the following be described as a device for especially grinding, delustring and similar surfaces where the tool is shaped as a grinding roller known as Fladdervalser®.

Figure 1:
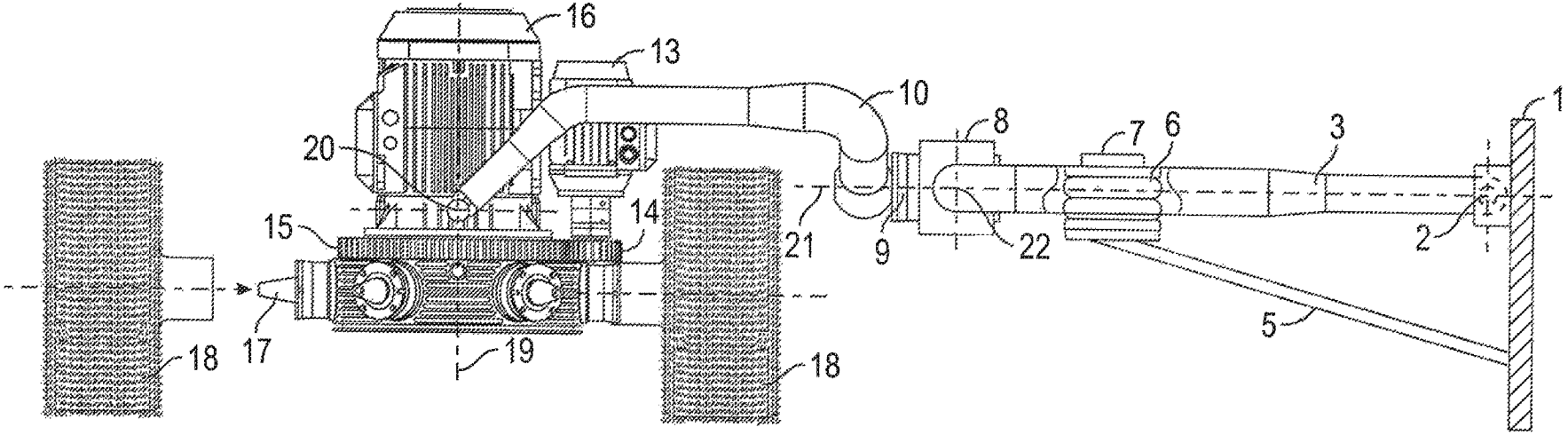
FIG. 1 shows a side view of a horizontally suspended tool.
Figure 3:
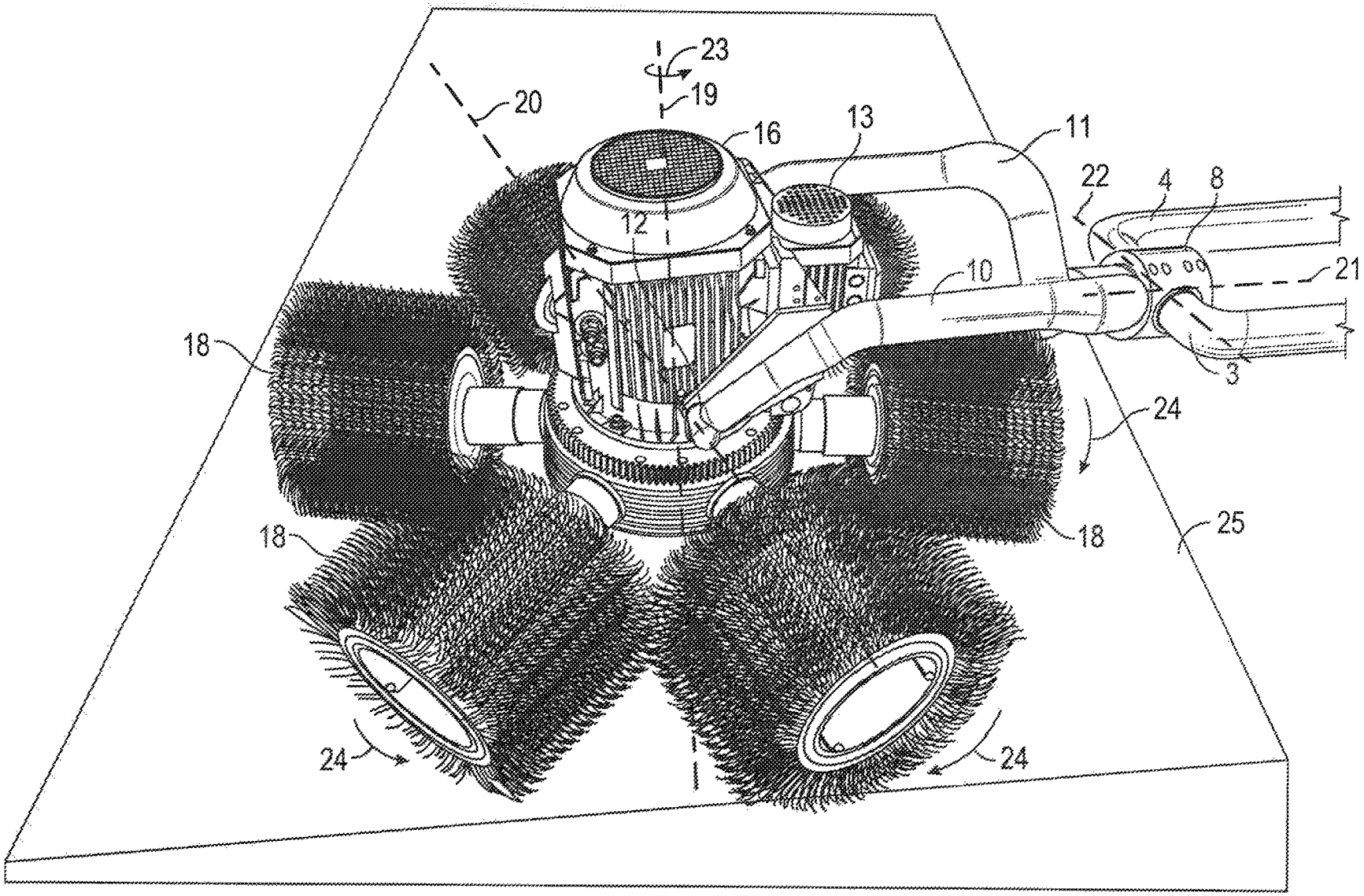
FIG. 3 shows the tool head treating a workpiece with an inclined surface.

These rollers 18 are, as shown in FIGS. 1 and 3, cylindrical tools consisting of slotted circular grinding elements which are juxtaposed to form a roller, thereby obtaining a grinding tool that is safe to use as a uniform grinding effect is obtained even where there are level differences in the workpiece surface.

As is shown by the figures, each roller 18 is secured to an axle-journal 17, of which this example has six journals spread evenly around the grinding head.

This grinding head contains a gearing driven by a motor 16.

The exchange is such that the grinding rollers 18 will be rotated around the centre axis of the tool, axis of rotation 19, in one direction 23, while the grinding rollers 18 will be rotated in adjacent opposite directions 24, as indicated with arrows in FIG. 3. This is to obtain a uniform surface treatment.

To rotate the grinding head a motor 13 with a gear 14 is mounted to the motor 16. The gear 14 is in engagement with a gear rim 15 on the grinding head.

Instead of the grinding rollers, rollers with other treatment means such as metal brushes, cutting rollers, polishing rollers, rolling sanders, and similar depending on the purpose, can be mounted in exactly the same way.

The motor 16 is fitted with opposite bearings 12 being rotatably mounted to the ends 10,11 of a suspension, thereby providing the tool head 13,14,15,16 with an axis of rotation denoted 20.

Figure 2:
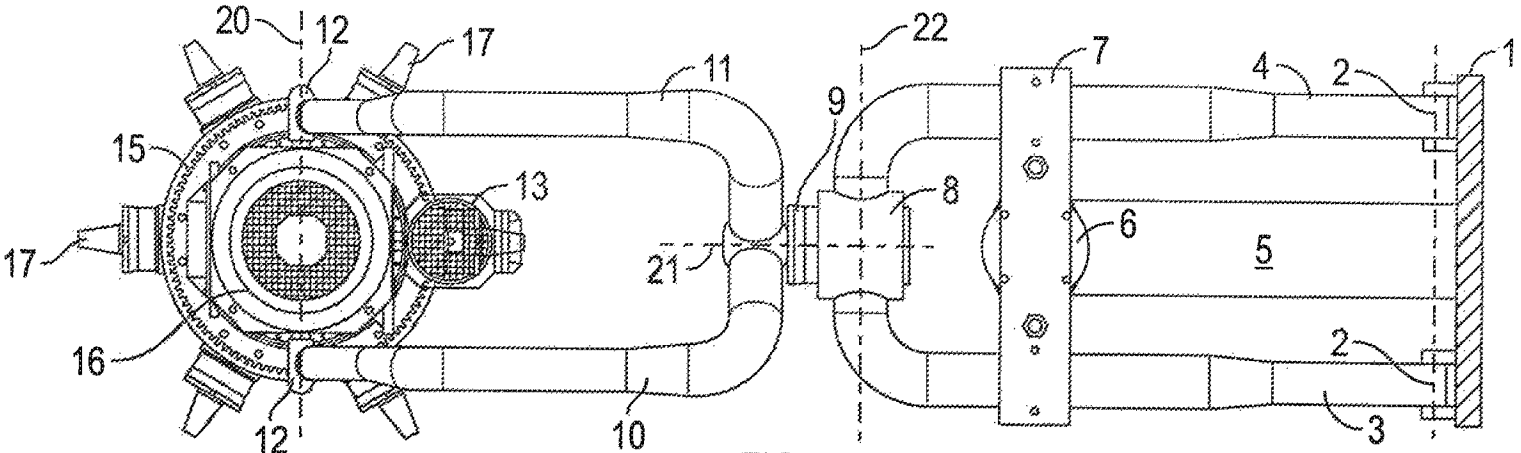
FIG. 2 shows the tool from above.

The ends 10,11 of the suspension are in the form of a fork-like arm, as shown in FIG. 2.

These ends 10,11 are rotatably mounted to a fitting bearing 9, thereby providing the suspension with an axis of rotation 21 perpendicular to the suspension axis 20 of the tool head in the opposite bearings 12. The fitting bearing is furthermore rotatably mounted to a fitting bracket 8, which makes the fitting bracket tiltable around an axis 22 perpendicular to the axis of rotation 21 and parallel to the suspension axis 20 of the tool head. These configurations constitute the gimbal effect of the tool head, which ensures that the tools 18 will always seek a position where they are leveled and dependent of the surface shape of the workpiece.

The fitting bracket 8 is supported by a supporting frame comprising two legs 3, 4, which supporting frame has ends 2 that are mounted to the surface treatment tool's support bracket 1.

To balance the tool there is, under a traversing beam 7 which connects the legs of the supporting device 3,4, mounted a weight compensator 6, which can be of any suitable kind; mechanical, hydraulic or pneumatic.

By means of this weight compensator 6, the weight of the tool head can be adjusted so that the tools 18 get the desired weight, and thereby the desired pressure against the surface of the workpiece 25.

If a higher treatment pressure is desired the balance is reduced, whereby the weight of the tool head is increased and vice versa. Hereby, the treatment pressure can be adjusted according to need.

By means of this device an even treatment pressure can be ensured, as well as a completely uniform treatment of the surface is ensured, whether this surface is arched, curved, concave or convex.

Furthermore, the weight balancing and the device's own weight together with the gimballed grinding equipment ensures a previously unknown freedom of treatment as the tool automatically adjusts according to the condition and shape of the surface.

This self-adjustment is achieved by simple means with no operational disadvantages; on the contrary a high degree of reliability, low wear and thus long durability is achieved without the use of energy and components such as adjustment equipment comprising sensors and adjustment settings.

The invention claimed is:

1. A surface treatment tool for treatment of workpiece surfaces (25), which tool comprises a rotating tool head (13,14,15,16) which is radially mounted several rotating tools (17,18), which rotating tools (17,18) include cylindrical, cutting or grinding rollers (18), wherein the tool head (13,14,15,16) is fitted with opposite bearings (12) being rotatably mounted to ends (10,11) of a suspension thereby providing said tool head (13,14,15,16) with an axis (20) of rotation, wherein the suspension is rotatably mounted to a fitting bearing (9) thereby providing the suspension with an axis (21) of rotation which is perpendicular on the axis (20) of rotation of the tool head (13,14,15,16), wherein the fitting bearing (9) is rotatably mounted to a fitting bracket (8) that is tiltable about a tilt axis (22) perpendicular to the axis (21) of the rotation of the suspension, wherein the ends (10,11) of said suspension are rotatably mounted to said opposite bearings (12) at a position below the fitting bracket (8) such that the axis of rotation (20) of the tool head is positioned at a level below the axis of rotation (21) of the suspension (10, 11).

2. The surface treatment tool according to claim 1, further comprising a supporting frame having legs (3, 4) mounted to a support bracket or base plate (1) wherein the fitting bracket (8) is supported by the supporting frame.

3. The surface treatment tool according to claim 2, wherein the supporting frame is supported by a weight compensator (6) comprising an actuator for compensation of the weight of the tool head (13,14,15,16) and the suspension ends (10, 11).

4. A method of treating a shaped surface with the surface treatment tool according to claim 1.

* * * * *